US005554307A

United States Patent [19]

Dagorn et al.

[11] Patent Number: 5,554,307

[45] Date of Patent: Sep. 10, 1996

[54] PROCESS FOR IMPROVING LUBRICATING BASE OIL QUALITY

[75] Inventors: Daniel N. N. Dagorn; Taous G. Mahtout; Pierre Grandvallet; Bob Scheffer, all of Grand Couronne, France

[73] Assignee: Shell Oil Company, Houston, Tex.

[21] Appl. No.: 559,521

[22] Filed: Nov. 15, 1995

[30] Foreign Application Priority Data

Nov. 16, 1994 [EP] European Pat. Off. ..... 94402602

[51] Int. Cl.[6] ..... C10M 125/02

[52] U.S. Cl. ..... 508/111; 208/99

[58] Field of Search ..... 252/29, 30; 208/98, 208/99

[56] References Cited

U.S. PATENT DOCUMENTS

| | | | |
|---|---|---|---|
| 3,697,414 | 10/1972 | Carpenter et al. . | |
| 3,830,723 | 8/1974 | Ladeur et al. . | |
| 4,447,315 | 5/1984 | Lamb et al. . | |
| 4,600,502 | 7/1986 | Butler et al. . | |
| 4,747,937 | 5/1988 | Hilfman et al. . | |
| 4,795,546 | 1/1989 | Miller . | |
| 4,954,242 | 9/1990 | Gruia . | |
| 5,189,092 | 2/1993 | Koslow | 524/495 |
| 5,277,729 | 1/1994 | Endo et al. | 156/157 |
| 5,331,037 | 7/1994 | Koslow | 524/496 |
| 5,417,846 | 5/1995 | Renard . | |

FOREIGN PATENT DOCUMENTS

| | | |
|---|---|---|
| 026508 | 8/1981 | European Pat. Off. . |
| 178710 | 4/1986 | European Pat. Off. . |
| 272729 | 6/1988 | European Pat. Off. . |
| 535910A2 | 4/1993 | European Pat. Off. . |
| 1546504 | 5/1979 | United Kingdom . |
| 2014058 | 8/1979 | United Kingdom . |

*Primary Examiner*—Jacqueline V. Howard

[57] ABSTRACT

A process for improving the quality of lubricating base oils, which process comprises contacting a lubricating base oil with dry activated carbon.

8 Claims, No Drawings

PROCESS FOR IMPROVING LUBRICATING BASE OIL QUALITY

BACKGROUND OF THE INVENTION

1. Field of the Invention

The present invention relates to a process for improving the quality of lubricating base oils.

2. Description of the Related Art

The "quality" of a lubricating base oil is determined by a combination of properties. Very important properties in this respect are storage stability and filterability of the base oil, and interfacial properties such as demulsibility, air release and foaming tendency. The present invention is particularly concerned with improving the storage stability, demulsibility and filterability of the base oil, whilst other relevant properties like air release and foaming tendency of the base oil are at least not negatively influenced. Under certain conditions air release and/or foaming may even be improved too in the process of the present invention. In any event, the overall quality of the lubricating base oil is improved.

All the aforementioned properties as well as methods for determining their values are well known in the field of base oil manufacture.

The storage stability indicates the number of days for an oil to produce a detectable change, other than a change in color, when stored in the dark at a certain temperature under oxidative conditions, usually in air. This is a very important characteristic of a lubricating base oil, since it gives an indication of how long a lubricating base oil could be stored whilst maintaining free of any deposits, haze or flocculation.

The demulsibility of a lubricating base oil is the ability of this oil to separate from water after the water and the oil have been intimately contacted and agitated so that an emulsion is formed. The demulsibility, accordingly, gives an indication of the rate of coalescence of water drops in the water-oil emulsion. This rate of coalescence, in return, is a good indication of the content of surface-active compounds (i.e. contaminants, hetero-atoms and aromatics) in the base oil, which compounds may originate from their natural occurrence in the fresh oil, from contaminants and/or from degradation reactions taking place during the manufacturing process of the base oil. Demulsibility is determined according to ASTM D1401.

The filterability of a lubricating base oil is a measure of the filter-blocking tendency of this oil. It is an important quality characteristic of a lubricating base oil, since many systems requiring lubrication contain filters whereby plugging of the filters needs to be avoided. Filterability is expressed in terms of the time needed to filter a certain volume of oil through a certain filter under certain conditions. This method for determining the filterability is known as the CETOP filterability method.

The foaming tendency of a lubricating base oil indicates the volume of foam which is generated after bubbling air through the oil for five minutes at a constant rate and temperature and the volume of foam still left ten minutes after the bubbling of air through the oil has stopped. It will be understood that foaming of a lubricating oil during operation may give rise to inadequate lubrication. The standard test method for determining foaming tendency of lubricating oils is ASTM D892.

The air release value of a lubricating base oil indicates the ability of this oil to separate entrained air and is defined as the number of minutes for air entrained in the oil to reduce in volume to 0.2% of its original volume at a certain temperature. A high air release value may indicate that the test oil contains a relatively high amount of air-retaining constituents, such as hetero-atoms (nitrogen, sulphur), polyaromatics and other polar compounds. The air release value is determined according to standard test method IP-313, which is technically identical to ASTM D3427.

In U.S. Pat. No. 4,795,546 a process for improving the storage stability of hydrocracked, catalytically dewaxed lubricating base oils is disclosed comprising a hydrofinishing step followed by a nonhydrogenative stabilization step. The hydrofinishing step involves contacting the dewaxed effluent with hydrogen in the presence of a suitable hydrogenation catalyst under mild hydrogenation conditions. The subsequent nonhydrogenative stabilization step involves contacting the hydrofinished dewaxed oil with a minor amount of an olefinic stabilizing agent in the presence of a heterogeneous acidic catalyst, such as acid resins, clays and aluminosilicates. From the said U.S. specification it becomes clear that the nonhydrogenative acid stabilization must be attributed to a reaction of the olefinic stabilizing agent with the floc forming species rather than to adsorption of these species onto the acidic catalyst. A first drawback of the stabilization method disclosed is the necessity of two distinct process steps, both requiring the presence of a different catalyst. It will be understood that this is undesired from a cost perspective. A further drawback is that the use of a stabilizing agent in the base oil may give rise to blending problems when adding additive packages later on. The olefinic stabilizing agent, namely, could easily interfere with the compounds constituting the additive package, which may give rise to problems with obtaining a stable and uniform blend. The possible interference between olefinic stabilizing agent and additive package may even cause (partial) neutralization of the effect of either the olefinic stabilizing agent or the additive package, which, in return, may have a detrimental effect on the stability of the final lubricating oil.

In European patent application No. 0,535,910 a process for improving the demulsibility of lubricating base oils is disclosed, which process comprises contacting the base oil with an adsorption means, which is either an acidic ion exchange resin or a silica adsorbent. The lubricating base oil is defined as an oil which has been solvent extracted and/or dewaxed and/or hydrotreated. From the disclosure it is, however, clear that the base oil has preferably been solvent extracted prior to contacting with the adsorbent in order to remove aromatic hydrocarbons. It is, however, clear from this patent application that any adsorbent other than an acidic ion exchange resin or silica is not expected to positively affect the base oil's demulsibility performance.

U.S. Pat. No. 4,600,502 relates to a process for decreasing the foaming tendency of lubricating base oils. The process involves passing the base oil through an adsorption zone in order to remove the foam producing compounds, which usually constitute less than 1% by weight of the total weight of the base oil. Before being passed through the adsorption zone the base oil has already been solvent extracted and/or hydrotreated and/or dewaxed in order to remove aromatic compounds. Accordingly, the adsorbent is chosen such, that the adsorption step is solely intended to remove foam producing compounds from the base oil and not to remove any other undesired species, such as certain aromatic compounds. The adsorbents used suitably are neutral or basic, with basic adsorbents being preferred. Among the many basic adsorbents listed, charcoal treated with a solution of a strong base is listed too. However, there is no suggestion that untreated charcoal might be suitable as well.

The processes taught in the prior art usually aim to improve only one single property of a lubricating base oil. The present invention, on the other hand, aims to provide a process for improving the overall quality and in particular the storage stability, demulsibility and filterability of lubricating base oils. Furthermore, the present invention aims to provide a process for improving the quality of lubricating base oils by only one single process step. The present invention also aims to provide a quality-improving process which can be installed and operated at relatively low expenses within existing refinery installations. One aspect in this connection is that the adsorbent to be used should be commercially available at an attractive and competitive price. Yet another aim of the present invention is to provide a process wherein the storage stability of a lubricating base oil is improved without employing any stabilizing agent in view of the addition of any additive packages to the base oil later on, when manufacturing the final tailor-made lubricating oil products.

All these aims have been achieved by the process according to the present invention, which involves improving the overall quality of lubricating base oils via one single adsorption step using dry activated carbon as the adsorbent.

In general, the use of activated carbon as an adsorbent is well known. In the manufacture of hydrocarbon oils, activated carbon is known to be particularly suitable for adsorbing polynuclear aromatic compounds. For instance, U.S. Pat. Nos. 3,697,414; 4,447,315; 4,747,937 and 4,954,242 all describe the use of activated carbon as an adsorbent for removing polynuclear aromatic compounds from different kinds of hydrocarbon streams.

However, none of the aforementioned prior art documents discloses or suggests the use of activated carbon, let alone dry activated carbon, as an adsorbent for improving the overall quality of lubricating base oils in terms of improving storage stability, demulsibility and filterability in one single adsorption step. It has now surprisingly been found that by contacting a lubricating base oil with dry activated carbon, all these properties are improved, whilst at the same time other intrinsic properties of the base oil (air release and foaming tendency) at least reach a commercially acceptable level and under certain conditions are even positively affected.

SUMMARY OF THE INVENTION

Accordingly, the present invention relates to a process for improving the quality of lubricating base oils, which process comprises contacting a lubricating base oil with dry activated carbon. More particularly, the present invention relates to a process for improving the quality of lubricating base oils in terms of storage stability, demulsibility and filterability, which process comprises the single step of contacting a lubricating base oil with dry activated carbon.

DESCRIPTION OF THE PREFERRED EMBODIMENTS

In general, activated carbon is a microcrystalline, non-graphitic form of carbon, which has been processed to develop internal porosity due to which it has a large surface area. The use of activated carbon as adsorbent for removing impurities from liquids and gases is well known and many commercial grades of activated carbon are available. For the purpose of the present invention, any activated carbon grade suitable as a liquid-phase adsorbent may be used. Activated carbons which have been found particularly suitable, are those having a surface area (N2, BET method) in the range from 500 to 1500 $m^2/g$, preferably from 900 to 1400 $m^2/g$, and a Hg pore volume in the range from 0.1 to 1.0 ml/g, preferably from 0.2 to 0.8 ml/g. With the expression "Hg pore volume" is meant the pore volume as determined by mercury porosimetry. Very good results have been obtained with activated carbons which additionally have a micropore size distribution of 0.2 to 2 nm with an average of 0.5 to 1 nm, a pore size distribution (Hg porosimetry) in the range from 1 to 10,000 nm, preferably from 1 to 5,000 nm, and a total pore volume as determined by nitrogen porosimetry in the range from 0.4 to 1.5 ml/g, preferably from 0.5 to 1.3 ml/g. Other preferred physical characteristics include an apparent bulk density of from 0.25 to 0.55 g/ml, a particle size of from 0.4 to 3.5 nm, preferably 0.5 to 1.5 nm, and a bulk crushing strength of at least 0.8 MPa, preferably at least 1.0 MPa. Examples of suitable commercially available activated carbons include FILTRASORB 400, DARCO GCL 8*30 and DARCO GCL 12*40 (FILTRASORB and DARCO are trade marks).

The activated carbon used in the process according to the present invention must be dry activated carbon. This means that the water content of the activated carbon should be less than 2% by weight, preferably less than 1% by weight and more preferably less than 0.5% by weight, based on total weight of activated carbon. This usually means that the activated carbon has to be dried first before application in the process of the present invention. Drying can be performed either ex situ or in situ via conventional drying procedures known in the art. Examples of suitable drying procedures are those wherein activated carbon is dried at a temperature in the range of from 100° to 350° C. for 2 to 48 hours in a nitrogen atmosphere. In case of applying a fixed bed of activated carbon, in situ drying the activated carbon, i.e. drying after the activated carbon has been packed into a bed, is preferred.

The lubricating base oil to be used in the process of the present invention may be any base oil prepared by methods known in the art. Accordingly, the base oil may, for instance, be obtained by the conventional process involving the successive steps of separating an atmospheric residue into one or more distillate fractions and a vacuum residue, deasphalting the vacuum residue, passing the distillate fraction(s) and the deasphalted vacuum residue through a solvent extraction unit and finally passing the solvent extracted oils through a solvent dewaxing unit. Alternatively, the base oil can be obtained via a process involving a catalytic dewaxing step instead of a solvent dewaxing step.

Very good results have been attained by the process according to the present invention, when using lubricating base oils produced by a process comprising at least one hydrotreatment step. Particularly the storage stability of hydroprocessed base oils usually leaves room for improvement. Processes for manufacturing hydroprocessed base oils are known in the art and in principle any such process may be used for producing the lubricating base oil which can be stabilized according to the process of the present invention. Suitable base oils may, for instance, be produced via a process, wherein a wax derived from a deasphalted residual oil is hydrocracked and subsequently dewaxed, such as disclosed in British patent specification No. 1,429,494. Another process for producing suitable base oils is the process disclosed in British patent specification No. 1,546,504, wherein waxy distillate fractions and/or a deasphalted waxy mineral oil fraction are catalytically hydrotreated in two successive stages, optionally followed by a dewaxing step. Yet another example of a process producing suitable base oils is the process described in European patent application No. 0,178,710. In this process lubricating base oils are prepared by solvent extracting distillate fractions and/or deasphalted oils prior to subjecting them to a single-stage catalytic hydrotreatment, optionally followed by a dewaxing treatment. Hydroprocessed lubricating base oils prepared via the process described in European patent application No. 0,272,729, which process involves the catalytic hydrotreatment and subsequent dewaxing of flashed distillates produced via a residue conversion process, such as hydrocracking, are also useful to be stabilized via the process according to the present invention. Beside the processes described, above there are many other ways known in the art involving at least one hydrotreatment step, which can also be used for producing suitable hydroprocessed lubricating base oils. However, hydroprocessed lubricating base oils produced according to any of the methods disclosed in British patent specification No. 1,546,504 and European patent application No. 0,178,710 have been found to be particularly suitable for use in the process according to the present invention, whereby base oils produced by the method disclosed in British patent specification No. 1,546,504 are most advantageously applied.

The conditions (temperature, pressure, space velocity) under which the lubricating base oil is contacted with the dry activated carbon may vary within a broad range in order to still attain an improved base oil quality. The temperature at which the contacting between base oil and activated carbon takes place, is nevertheless an important parameter in view of its influence on the viscosity of the base oil. It will be understood that in order to allow optimum contact between the activated carbon and the base oil, the viscosity of the base oil should be such that the contact between the base oil and the activated carbon enables the undesired species to be adsorbed. Accordingly, the temperature should be such that the viscosity of the base oil at that temperature allows effective contact between the base oil and the activated carbon, so that the undesired species can be adsorbed. Temperatures in the range of from 20° to 300° C., preferably 50° to 200° C., more preferably 40° to 150° C., have been found to be suitable in this respect. The operating pressure of the process according to the present invention is not particularly critical and may be in the range of from 1 to 200 bar, preferably 1 to 100 bar, most preferably 1 to 10 bar. A suitable weight hourly space velocity has been found to be in the range of from 0.2 to 25 kg/l/hr, preferably from 0.5 to 10 kg/l/hr and more preferably from 1 to 5 kg/l/hr.

Contacting the lubricating base oil with the activated carbon may be realized in ways known in the art, such as by suspending the activated carbon particles throughout the base oil followed by filtration. Another way of contacting a base oil with activated carbon is passing the base oil through a filter of activated carbon. It has, however, been found very advantageous to pass the lubricating base oil through at least one fixed bed of activated carbon, after which the stabilized base oil can be recovered. It will be understood that the number of fixed beds of activated carbon is determined by parameters, such as base oil manufacture capacity, level of contaminants present in the base oils and correlated fouling rate of the activated carbon beds. In case more than one fixed bed of activated carbon is used, these beds may be arranged in series, in parallel or in a combination of both. In general, it may be advantageous to arrange the fixed beds of activated carbon in such mode that at least one spare bed of activated carbon is available and that each bed can be bypassed, so that replacement of fouled activated carbon beds is possible without having to interrupt the supply of base oil feed. If the beds are arranged in series, this situation may for instance be attained by systems known from the field of residue hydroconversion fixed bed operations, such as those systems disclosed in British patent specification No. 2,014,058 and European patent application No. 0,026,508. If the beds are arranged in parallel, a two-bed configuration whereby both beds are alternately operated as described in European patent application No. 0,450,997 for hydrodemetallization guard bed reactors may be applied. Another option is to arrange the fixed beds such, that there is always at least one spare bed which is not in operation. Accordingly, if the activated carbon in one fixed bed is fouled and needs to be replaced, then the flow of base oil can be passed over the spare bed and the fouled bed can be bypassed, thus allowing the contaminated activated carbon to be replaced by fresh or regenerated activated carbon. This bed can then be kept as the spare bed until the next bed is fouled. Such mode of operation, thus, allows a continuous flow of base oil to be contacted with activated carbon for improving its quality.

The invention is illustrated by the following examples without restricting the scope of the present invention to these particular embodiments.

EXAMPLE 1 AND COMPARATIVE EXAMPLE 1

A lubricating base oil having the properties listed in Table I ("Feed") was passed over a bed of activated carbon, which had not been dried prior to contact with the base oil, at an operating temperature of 70° C., a space velocity of 4 kg/l/hr (9.3 kg/kg/hr) and an operating pressure of 1 bar. The activated carbon used was DARCO GCL 8*30 ex NORIT (Hg pore volume 0.40 ml/g, N2 surface area 1050 $m^2/g$) and 100 ml (48 g) of this activated carbon was loaded into a reactor (diameter 20 mm, volume 300 ml), so that a fixed bed of activated carbon was obtained. Relevant properties of the treated base oil are listed in Table I ("Comp.Ex. 1").

The same procedure was repeated, only this time the activated carbon was dried in situ, i.e. after having been loaded into the reactor, at 250° C. for 4 hours under a nitrogen flow of 50 Nl/hr. Water content of the dried activated carbon was below 0.5% wt. Relevant properties of the treated base oil are listed in Table I ("Ex. 1").

Storage stability was measured by determining the number of days for the oil to produce a detectable change (deposits, haze, suspension), other than a change in color, when stored in the dark at 70° C. under an air blanket in a sealed test cylinder of transparent glass. In these experiments, a storage stability of less than 60 days is considered unacceptable.

Demulsibility was determined according to ASTM D1401 and is expressed as volume of oil phase in ml/volume of water phase in ml/volume of emulsion layer between oil and water phase in ml (time required to obtain the state indicated in minutes).

TABLE I

| | Adsorption over dry activated carbon | | |
|---|---|---|---|
| | Feed | Comp. Ex. 1 | Ex. 1 |
| Vk40 (cSt) | 71.4 | 71.1 | 71.7 |
| Vk 100 (cSt) | 9.0 | 9.0 | 9.0 |
| VI | 99 | 99 | 99 |
| Storage Stability (days) | 17 | 18 | >60 |
| Demulsibility (ml/ml/ml (min)) | 40/37/3 (15) | 40/37/3 (50) | 40/40/0 (5) |

In Table I Vk40 stands for kinematic viscosity at 40° C., Vk100 for kinematic viscosity at 100° C. and VI for Viscosity Index.

From Table I it becomes clear that using "wet" activated carbon as the adsorbent does not improve the storage stability of a lubricating base oil and even deteriorates the demulsibility of the base oil. Using dry activated carbon as the adsorbent, on the other hand, results in a base oil having improved storage stability and demulsibility. Accordingly, in order to improve the overall quality of lubricating base oils it is essential that dry activated carbon is used as the adsorbent.

EXAMPLE 2

100 ml (43 g) of activated carbon (FILTRASORB 400 ex CHEMVIRON, Hg pore volume 0.40 ml/g, N2 surface area 1100 $m^2/g$) was loaded into a reactor (diameter 20 mm, volume 300 ml), so that a fixed bed of activated carbon was obtained. The activated carbon was subsequently dried in situ for 24 hours at 180° C. with a nitrogen flow of 50 Nl/hr under 10 bar pressure, so that the water content was reduced to below 0.5% by weight.

A continuous flow of hydroprocessed lubricating base oil obtained by the process according to British patent specification No. 1,546,504 and having the properties as listed in Table II was passed over the bed of dry activated carbon for two months at an operating temperature of 130° C., a space velocity of 2.6 kg/l/hr (6 kg/kg/hr) and an operating pressure of 10 bar. The properties of the untreated base oil (feed) and those of a sample of treated base oil obtained after two months of operation (denoted as "Product") are listed in Table II.

Filterability was determined according to the CETOP method and the time needed to filter 1000 ml of oil is indicated.

Air release was determined according to the method IP 313 and is expressed in minutes.

Foaming tendency was determined according to ASTM D892 and is expressed in ml/ml: volume in milliliters of foam directly after bubbling air through for five minutes/volume in milliliters of foam left ten minutes after bubbling of air has stopped.

TABLE II

Improvement of hydroprocessed lubricating base oil quality by activated carbon adsorption

| | | Feed | Product |
|---|---|---|---|
| Vk 40 | ($mm^2/s$) | 71.9 | 71.8 |
| Vk 100 | ($mm^2/s$) | 9.11 | 9.11 |
| VI | | 101 | 101 |
| Total sulphur | (mg/kg) | 148 | 142 |
| Total nitrogen | (mg/kg) | 4 | 3 |
| Monoaromatics | (mmole/100 g) | 43.2 | 43.4 |
| Polyaromatics | (mmole/100 g) | 8.0 | 7.8 |
| Storage stability | (days) | 6 | >60 |
| Demulsibility | (ml/ml/ml (min)) | 40/33/7 (60) | 40/40/0 (9) |
| Time to filter 1000 ml | (min) | >60 | 45 |
| Foaming tendency | (ml/ml) | 290/0 | 30/0 |
| Air release at 50° C. | (min) | 9 | 6 |

From Table II it can be seen that the base oil quality indeed improves after activated carbon adsorption. It can also be seen that this improved quality cannot be solely attributed to the adsorption of polyaromatic species, as only a very small portion of the polyaromatics present in the feed is adsorbed.

EXAMPLE 3

The procedure of Example 2 was repeated under different operating conditions with another hydroprocessed lubricating base oil and with a solvent extracted lubricating base oil obtained by the conventional solvent extraction process involving the successive steps of vacuum distillation of an atmospheric residue, solvent extraction and solvent dewaxing. The properties of both base oil feeds are listed in Table III.

The conditions applied in this example for both feeds were an operating temperature of 70° C., a space velocity of 4 kg/l/hr (9.3 kg/kg/hr) and an operating pressure of 1 bar.

The properties of the treated lubricating base oils (denoted as "Product") are listed in Table III ("nd" means not determined).

TABLE III

Activated carbon adsorption of lubricating base oils

| | | Hydroprocessed | | Solvent extracted | |
|---|---|---|---|---|---|
| | | Feed | Product | Feed | Product |
| Vk 40 | ($mm^2/s$) | 71.4 | 71.4 | 28.0 | 27.7 |
| Vk 100 | ($mm^2/s$) | 9.06 | 9.02 | 5.04 | 5.10 |
| VI | | 101 | 100 | 106 | 113 |
| Total sulphur | (mg/kg) | 106 | 100 | 6600 | 6600 |
| Total nitrogen | (mg/kg) | 2.1 | 3.7 | 21 | 20 |
| Monoaromatics | (mmole/100 g) | 55.9 | 55.0 | 40.9 | 42.4 |
| Polyaromatics | (mmole/100 g) | 7.6 | 7.5 | 8.9 | 8.7 |
| Storage stability | (days) | 31 | >60 | >60 | >60 |
| Demulsibility | (ml/mo/ml (min)) | 40/37/3 (15) | 40/40/0 (5) | 40/37/3 (20) | (40/40/0 (15) |
| Time to filter 1000 ml | (min) | 80 | 45 | 19 | 16 |
| Air release at 50° C. | (min) | 8 | 8 | nd | nd |

Table III again illustrates that activated carbon adsorption improves the quality of lubricating base oils. Table III also shows that for a solvent extracted base oil particularly the demulsibility is improved by activated carbon adsorption, whilst filterability and storage stability of the untreated base oil are already good in this case and remain good after the adsorption treatment.

What is claimed is:

1. A process for improving the quality of hydroprocessed lubricating base oils, which process comprises contacting a hydroprocessed lubricating base oil with dry activated carbon.

2. The process according to claim 1, wherein the lubricating base oil and the dry activated carbon are contacted at a temperature in the range of from 20° to 300° C., preferably 50° to 200° C.

3. The process according to claim 1 wherein the contacting with activated carbon takes place by passing the lubricating base oil through at least one fixed bed of activated carbon.

4. The process according to claim 2 wherein the contacting with activated carbon takes place by passing the lubricating base oil through at least one fixed bed of activated carbon.

5. The process according to claim 1 wherein the dry activated carbon has a surface area (N2, BET method) in the range from 500 to 1500 $m^2/g$ and a Hg pore volume in the range from 0.1 to 1.0 ml/g.

6. The process according to claim 2 wherein the dry activated carbon has a surface area (N2, BET method) in the range from 500 to 1500 $m^2/g$ and a Hg pore volume in the range from 0.1 to 1.0 ml/g.

7. The process according to claim 3 wherein the dry activated carbon has a surface area (N2, BET method) in the range from 500 to 1500 $m^2/g$ and a Hg pore volume in the range from 0.1 to 1.0 ml/g.

8. The process according to claim 4 wherein the dry activated carbon has a surface area (N2, BET method) in the range from 500 to 1500 $m^2/g$ and a Hg pore volume in the range from 0.1 to 1.0 ml/g.

* * * * *